US010324394B2

(12) United States Patent
Okuyama

(10) Patent No.: US 10,324,394 B2
(45) Date of Patent: Jun. 18, 2019

(54) DEVELOPING DEVICE

(71) Applicant: CANON KABUSHIKI KAISHA, Tokyo (JP)

(72) Inventor: Yuta Okuyama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/890,026

(22) Filed: Feb. 6, 2018

(65) Prior Publication Data

US 2018/0224766 A1 Aug. 9, 2018

(30) Foreign Application Priority Data

Feb. 8, 2017 (JP) ..... 2017-021511

(51) Int. Cl.

| | |
|---|---|
| ***G03G 13/09*** | (2006.01) |
| ***G03G 15/20*** | (2006.01) |
| ***G03G 21/16*** | (2006.01) |
| ***G03G 9/107*** | (2006.01) |
| ***G03G 9/083*** | (2006.01) |
| ***G03G 15/08*** | (2006.01) |
| ***G03G 15/09*** | (2006.01) |
| *G03G 15/01* | (2006.01) |

(52) U.S. Cl.

CPC ..... *G03G 13/09* (2013.01); *G03G 9/0834* (2013.01); *G03G 9/107* (2013.01); *G03G 9/1075* (2013.01); *G03G 15/0818* (2013.01); *G03G 15/0928* (2013.01); *G03G 15/2053* (2013.01); *G03G 21/168* (2013.01); *G03G 15/0115* (2013.01)

(58) Field of Classification Search

None

See application file for complete search history.

(56) References Cited

U.S. PATENT DOCUMENTS

| | | | | | |
|---|---|---|---|---|---|
| 6,097,923 | A * | 8/2000 | Iwakura | G03G 15/1685 | 399/303 |
| 2009/0110443 | A1* | 4/2009 | Yamada | G03G 15/0812 | 399/284 |
| 2013/0236218 | A1* | 9/2013 | Inagaki | G03G 15/0131 | 399/302 |
| 2015/0227087 | A1* | 8/2015 | Kubo | G03G 15/0921 | 399/276 |
| 2016/0274489 | A1* | 9/2016 | Juri | G03G 15/0818 | |
| 2016/0349670 | A1* | 12/2016 | Kubo | G03G 15/0921 | |

FOREIGN PATENT DOCUMENTS

| | | | |
|---|---|---|---|
| JP | 2-50182 | A | 2/1990 |
| JP | 2-64561 | A | 3/1990 |
| JP | 2010217237 | A * | 9/2010 |
| JP | 2011-100003 | A | 5/2011 |
| JP | 2011170100 | A * | 9/2011 |

* cited by examiner

*Primary Examiner* — Sevan A Aydin

(74) *Attorney, Agent, or Firm* — Canon U.S.A., Inc. IP Division

(57) ABSTRACT

A developing device includes a developing sleeve configured to carry and convey developer containing non-magnetic toner and magnetic carrier and having a plurality of concave parts on a surface thereof. The concave parts are periodically arranged in each of a rotation direction and a width direction of the developing sleeve, and each have a shape that can house a circular shape having a diameter equal to an average particle diameter of the carrier carried on the developing sleeve, in a planar view. A distance between the concave parts is smaller than the average particle diameter.

18 Claims, 7 Drawing Sheets

DEVELOPING DEVICE

BACKGROUND OF THE INVENTION

Field of the Invention

The present disclosure relates to a developing device used for an image forming apparatus of an electrophotographic type, an electrostatic recording type, or the like.

Description of the Related Art

In an existing image forming apparatus employing an electrophotographic system, an electrostatic latent image formed on an image bearing member such as a photosensitive drum is developed with a resin containing colorant or the like, to form a visible image. In an existing developing device used for such development, two-component developer (hereinafter, referred to as developer) that contains non-magnetic toner and magnetic carrier is widely used as developer.

In the developing device using the two-component developer, in a developing region where the image bearing member and a developer bearing member (hereinafter, referred to as developing sleeve) face each other, the developer forms a brush shape (hereinafter, magnetic brush) by a magnet that is fixed and disposed inside the developing sleeve. In other words, the developer is borne on the developing sleeve by the magnet disposed in the developing sleeve, and the magnetic carrier forms the magnetic brush along magnetic field lines of the magnet. The magnetic brush is conveyed through rotational driving of the developing sleeve; however, conveyance failure may occur due to shortage of conveyance force when the magnetic brush is conveyed in the developing region. Such conveyance failure of the developer the developing region may cause deterioration of image density in some cases.

To enhance conveyance performance of the developer by the developing sleeve to solve such an issue, a developing device in which concave parts are provided on a surface of the developing sleeve, and the magnetic brush is formed with the carrier engaged with the concave parts as starting points has been proposed. As a form of each of the concave parts, for example, a random shape (see Japanese Patent Application Laid-Open. No. 2-64561), a groove shape parallel to an axis direction of the developing sleeve (see Japanese Patent. Application Laid-Open No. 2-50182), and a linearly-continuous elliptical shape (see Japanese Patent Application Laid-Open No. 2011-100003) have been proposed. Such developing devices make it possible to improve followability of the magnetic brush with respect to the rotation of the developing sleeve.

In the development using the two-component developer, when the developer is conveyed to a region where the developing sleeve comes close to the image bearing member, the magnetic brush comes into contact with the image bearing member. Thereafter, the magnetic brush is separated from the image bearing member after passing through a region where the developing sleeve comes closest to the image bearing member. The region where the magnetic brush is in contact with the image bearing member is called a contact nip, and the toner adheres to the electrostatic latent image on the image bearing member mainly in the contact nip, and the toner image is accordingly formed. In the image forming process, roughness of the image particularly relates to a region where the magnetic brush starts to separate from the image bearing member on the downstream end of the contact nip in the conveyance direction. For example, if the contact state of the magnetic brush to the image bearing member before separation is non-uniform, the toner image formed in the contact nip is disturbed, which increases roughness of the output image.

Non-uniformity of the contact state of the magnetic brush on the downstream end of the contact nip in the conveyance direction easily occurs when a length of the magnetic brush and the distance between the bristles of the magnetic brush formed on the developing sleeve are non-uniform. The length of the magnetic brush and the distance between the bristles of the magnetic brush closely relate to the surface shape of the developing sleeve. As Japanese Patent Application Laid-Open Nos. 2-64561, 2-50182, and 2011-100003, in the developing sleeve having irregularity on the surface to improve the conveyance force of the developing sleeve, the conveyance force of the concave parts is strong and the magnetic brush tends to be collected in the concave parts. Consequently, in the developing devices discussed in Japanese Patent Application Laid-Open Nos. 2-64561, 2-50182, and 2011-100003, the distance between the bristles of the magnetic brush and the length of the magnetic brush on the developing sleeve are non-uniform. The non-uniform contact state of the magnetic brush on the downstream end of the contact nip in the conveyance direction occurs, which adversely affects roughness of the image.

First, in the developing device discussed in Japanese Patent Application Laid-Open No. 2-64561, the sizes and the distance of the concave parts vary because irregularity is randomly provided on the surface of the developing sleeve. Accordingly, the bristles of the magnetic brush are densely present in a region where the concave parts are densely provided, and the bristles of the magnetic brush are sparsely present in a region where the distance between the concave parts is wide, which causes non-uniformity of the distances between the bristles of the magnetic brush. Further, the magnetic brush typically has a conical shape in which a root is thick and a thickness is gradually reduced toward a tip. Therefore, a large amount of carrier is easily collected in a large concave part and the magnetic brush having a large root and a long length is easily formed. If the sizes of the concave parts are non-uniform, the length of the formed magnetic brush also becomes non-uniform.

Moreover, in the developing device discussed in Japanese Patent Application Laid-Open No. 2-50182, the groove parallel to the axis direction is provided on the surface of the developing sleeve. In this configuration, the developer is easily collected in the grove and the amount of the developer carried on the groove is larger than the amount of the developer carried on the surface other than the groove. As a result, the magnetic brush in the groove becomes larger in length than the magnetic brush on the surface other than the groove.

Furthermore, in the developing device discussed in Japanese Patent Application Laid-Open No. 2011-100003, the concave parts are regularly provided to regularly form the magnetic brush; however, the developer exists on the surface other than the concave parts because the distance between the concave parts in a circumferential direction is large. As a result, the magnetic brush is not sufficiently regulated in the pattern of the concave parts, which results in the non-uniform state of the magnetic brush.

SUMMARY OF THE INVENTION

The present disclosure is directed to a developing device that makes it possible to stabilize a state where magnetic brush is in contact with an image bearing member on a downstream end of a contact nip in a conveyance direction.

According to an aspect of the present disclosure, a developing device includes a developer bearing member configured to be rotatable and to carry non-magnetic toner and magnetic carrier, a magnet provided inside the developer bearing member, and a plurality of concave parts provided on a surface of an entire region where developer is carried, in a rotation axis direction of the developer bearing member. Each of the concave parts has a surface size larger than a volume average particle diameter of the carrier, and the plurality of concave parts are arranged to make a shortest distance between the concave parts adjacent to each other smaller than the volume average particle diameter of the carrier.

Further features of the present disclosure will become apparent from the following description of exemplary embodiments with reference to the attached drawings.

DESCRIPTION OF THE EMBODIMENTS

Figure 1:
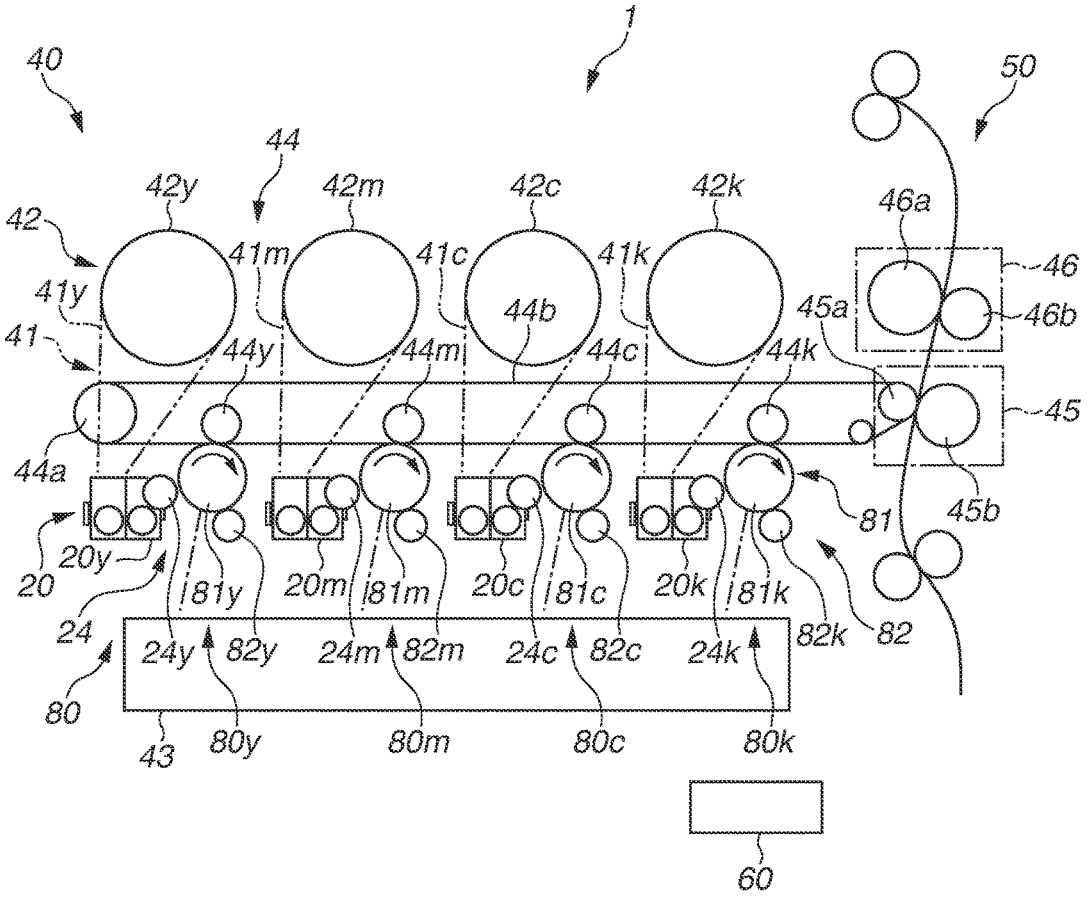
FIG. 1 a cross-sectional view illustrating a schematic configuration of an image forming apparatus according to an exemplary embodiment.

A developing device according to an exemplary embodiment of the present disclosure will be described in detail below with reference to FIGS. 1 to 4. In the present exemplary embodiment, a case where the developing device is applied. to a tandem full-color printer as an example of an image forming apparatus is described. The present disclosure, however, is not limited to the developing device of the tandem image forming apparatus, and may be a developing device of an image forming apparatus of other type. In addition, the present disclosure is not limited to full color and may be monochrome or mono-color. Alternatively, the present disclosure may be implemented for various applications such as a printer, a printing apparatus, a copier, a facsimile machine, and a multifunction apparatus by including necessary device, equipment, and housing structure. In the present exemplary embodiment, an image forming apparatus 1 includes an intermediate transfer belt 44*b*, and primarily transfers toner images of respective colors from a photosensitive drum 81 to the intermediate transfer belt 44*b*, and then collectively secondarily transfers a composite toner image of the colors to a sheet S. The method, however, is not limited thereto, and the image forming apparatus 1 may adopt a method of directly transferring the image from the photosensitive drum to a sheet conveyed by a sheet conveyance belt.

Further, in the present exemplary embodiment, a two-component developer that is a mixture of non-magnetic toner and magnetic carrier, is used as developer. The toner contains binder resin, colorant, colored resin particles containing other additive as necessary, and colored particles that are externally added with an external additive such as colloidal silica fine powder. The toner contains colorant, a wax component, etc. in a resin such as negatively-charged polyester or styrene, and is powdered through grinding or polymerization in the present exemplary embodiment, volume average particle diameter of the toner is 7.0 μm. The carrier is formed by performing resin coating on a surface layer of a core including a ferrite particle or a resin particle kneaded with magnetic powder.

As the carrier, for example, metals such as surface-oxidized or non-oxidized iron, nickel, cobalt, manganese, chromium, and rare earths, and an alloy thereof, or oxide ferrite may be suitably used. In the present exemplary embodiment, the carrier having the oxide ferrite as a core are used; however, the method of manufacturing the magnetic particles is not particularly limited. The contact of the magnetic brush with the photosensitive drum 81 becomes uniform to obtain favorable image quality as the particle diameter of the carrier becomes smaller; however, carrier adhesion to the photosensitive drum 81 becomes remarkable, which causes image failure. Accordingly, an average particle diameter 2R (hereinafter, "particle diameter" in brief indicates volume average particle diameter) of the volume distribution reference of the carrier is desirably approximately 20 μm to 50 μm. A mixing ratio of the developer in the present exemplary embodiment is 10% in a ratio of the toner to the total weight. The carrier, however, is not limited thereto as a matter of course.

As illustrated in FIG. 1, the image forming apparatus 1 includes an image forming section 40, a sheet conveyance unit 50, a control unit 60, and the like inside an unillustrated apparatus body. The sheet conveyance unit conveys the sheet S that has been fed from an unillustrated sheet feeding unit, to an unillustrated sheet discharging unit from the image forming section 40 The sheet S serving as a recording medium is to be formed with toner images, and specific examples of the sheet S include a regular paper, a resin sheet as a substitute for the regular paper, a thick paper, and an overhead projector sheet.

The image forming section 40 includes an image forming unit 80, a toner bottle 41, a toner container 42, a laser scanner 43, an intermediate transfer unit 44, a secondary transfer unit 45, and a fixing device 46. The image forming section 40 can form an image on the sheet S, based on image information The image forming apparatus 1 according to the present exemplary embodiment supports full color, and image forming units 80*y*, 80*m*, 80*c*, and 80*k* are respectively provided with similar configurations for four colors of yellow (y) , magenta (m) , cyan (c) , and black (k). Likewise, toner bottles 41*y*, 41*m*, 41*c*, and 41*k* and toner containers 42*y*, 42*m*, 42*c*, and 42*k* are respectively provided with similar configurations for the four colors of yellow (v), magenta (m), cyan (c), and black (k). Accordingly, in FIG. 1, a color identifier is added after the same reference numeral for configurations of the respective four colors; however, in FIG. 2, FIG. 3, and The specification, description is given only with a reference numeral without addition of the color identifier in some cases.

The toner container 42 is, for example, a cylindrical bottle which houses the toner, and is disposed above The corresponding image forming unit 80 so as to be coupled to the corresponding image forming unit 80 via the toner bottle 41. The laser scanner 43 exposes a surface of the photosensitive drum 81 that has been charged by a charging roller 82, thereby forming an electrostatic latent image on the surface of the photosensitive drum 81.

The image forming unit 80 includes the four image forming units 80*y*, 80*m*, 80*c*, and 80*k* to form the toner images of the four colors. The image forming unit 80 includes the photosensitive drum 81 forming the toner image, the charging roller 82, the developing device 20, and an unillustrated cleaning blade. The photosensitive drum 81, the charging roller 82, the developing device 20, and a developing sleeve 24 described later are also separately provided with similar configurations for each of the four colors of yellow (y), magenta (m), cyan (c), and black (k).

The photosensitive drum 81 includes a photosensitive layer and rotates in an arrow direction at a predetermined process speed (circumferential speed). The photosensitive layer is provided so as to have a negative charge polarity on an outer peripheral surface of an aluminum cylinder. The charging roller 82 comes into contact with the surface of the photosensitive drum 81 to charge the surface of the photosensitive drum 81 to, for example, homogeneous negative dark portion potential. After charging, an electrostatic image is formed on the surface of the photosensitive drum 81 by the laser scanner 43, based on the image information. The photosensitive drum 81 revolves while carrying the formed electrostatic image, and an image is developed with the toner by the developing device 20. A detailed configuration of the developing device 20 is described later. The developed toner image is primarily transferred to the intermediate transfer belt 44*b* described later. The surface of the photosensitive drum 81 after the primary transfer is discharged by an unillustrated pre-exposure unit.

The intermediate transfer unit 44 is disposed above the image forming units 80*y*, 80*m*, 80*c*, and 80*k*. The intermediate transfer unit 44 includes a plurality of rollers including a driving roller 44*a*, primary transfer rollers 44*y*, 44*m*, 44*c*, and 44*k*, and the intermediate transfer belt 44*b* wound on these rollers. The primary transfer rollers 44*y*, 44*m*, 44*c*, and 44*k* are disposed to respectively face the photosensitive drums 81*y*, 81*m*, 81*c*, and 81*k*, and come into contact with the intermediate transfer belt 44*b*.

When positive transfer bias is applied to the intermediate transfer belt 44*b* through the primary transfer rollers 44*y*, 44*m*, 44*c*, and 44*k*, the negative toner images on the photosensitive drums 81*y*, 81*m*, 81*c*, and 81*k* are sequentially transferred on the intermediate transfer belt 44*b* in a multiple manner. Thereafter, the intermediate transfer belt 44*b* moves while the toner image that has been obtained by developing the electrostatic image on the surfaces of the respective photosensitive drums 81*y*, 81*m*, 81*c*, and 81*k* is transferred thereon.

The secondary transfer unit 45 includes a secondary inner transfer roller 45*a* and a secondary outer transfer roller 45*b*. Positive secondary transfer bias is applied to the secondary outer transfer roller 45*b* to transfer the full-color image formed on the intermediate transfer belt 44*b* to the sheet S. The fixing device 46 includes a fixing roller 46*a* and a pressurizing roller 46*b*. The sheet S is held and conveyed between the fixing roller 46*a* and the pressurizing roller 46*b*. As a result, the full-color image transferred on the sheet S is heated and pressurized, and is fixed to the sheet S.

The control unit 60 includes a computer, and includes, for example, a central processing unit (CPU), a read only memory (ROM) that stores programs controlling respective units, a random access memory (RAM) that temporarily stores data, and an input/output circuit (I/F) that exchanges signals with outside. The CPU is a microprocessor that performs whole control of the image forming apparatus 1, and is a main component of a system controller. The CPU is connected to, for example, the sheet feeding unit, the image forming section 40, and the sheet conveyance unit 50 through the input/output circuit, and exchanges the signals with the respective units and controls operation of the respective units.

Next, image forming operation by the image forming apparatus 1 having such a configuration will be described. When the image forming operation is started, the photosensitive drum 81 first rotates and the surface thereof is charged by the charging roller 82. Thereafter, a laser beam is applied from the laser scanner 43 to the photosensitive drum 81, based on the image information, and the electrostatic latent image is accordingly formed on the surface of the photosensitive drum 81. When the toner adheres to the electrostatic latent image, the electrostatic latent image is developed and is visualized as the toner image, and the toner image is transferred to the intermediate transfer belt 44*b*.

In contrast, the sheet conveyance unit 50 operates in parallel with such formation operation of the toner image, and conveys the sheet S fed from the sheet feeding unit, to the secondary transfer unit 45 while matching the timing with the toner image on the intermediate transfer belt 44*b*. Thereafter, the image is transferred from the intermediate transfer belt 44*b* to the sheet S. The sheet S is conveyed to the fixing device 46, and the unfixed toner image is fixed to the surface of the sheet S through heating and pressurization, and the sheet S is then discharged to the sheet discharging unit.

Next, the developing device 20 will be described with reference to FIG. 2 and FIG. 3. The developing device 20 is detachable to the apparatus main body, and includes a developer container 21 housing the developer, a first conveyance screw 22, a second conveyance screw 23, the developing sleeve (developer bearing member) 24, a regulation blade 25, and an inductance sensor 26. The developer container 21 includes an opening 21*a* from which the developing sleeve 24 is exposed, at a position facing the photosensitive drum 81.

The developer container 21 includes, at a substantially center, a partition wall 27 that extends in a longitudinal direction The developer container 21 is partitioned in the horizontal direction by the partition wall 27 into a developing chamber 21*b* and an agitating chamber 21*c*. The developer is housed in the developing chamber 21*b* and the agitating chamber 21*c*. The developing chamber 21*b* supplies the developer to the developing sleeve 24. The agitating chamber 21*c* communicates with the developing chamber 21*b*, and recovers and agitates the developer from the developing sleeve 24. The partition wall 27 between the developing chamber 21*b* and the agitating chamber 21*c* includes two communication portions 27*a* and 27*b* that communicates the developing chamber 21*b* and the agitating chamber 21*c* with each other, at both end parts. In the developing device 20 of the present exemplary embodiment, the developing chamber 21*b* and the agitating chamber 21*c* are disposed in the horizontal direction; however, the configuration is not limited thereto. The developing chamber and the agitating chamber may be disposed in a vertical direction, or a developing device may have other form.

The first conveyance screw 22 is disposed, in the developing chamber 21*b*, in substantially parallel to the developing sleeve 24 along an axis direction of the developing sleeve 24, and conveys the developer in the developing chamber 21*b* while agitating the developer. The first conveyance screw 22 includes a shaft part 22*a*, and a spiral conveyance blade 22*b*. The shaft part 22*a* is rotatably provided. in the developer container 21 and has magnetism. The conveyance blade 22*b* rotates integrally with the shaft part 22*a* and conveys the developer inside the developer container 21 in a conveyance direction D1 through rotation.

The second conveyance screw 23 is disposed, in the agitating chamber 21*c*, in substantially parallel to an axis of the first conveyance screw 22, and conveys the developer in the agitating chamber 21*c* in a direction opposite to the conveyance direction of the first conveyance screw 22. The second conveyance screw 23 includes a shaft part 23*a* and a spiral nonmagnetic conveyance blade 23*b*. The shaft part 23*a* is rotatably provided in the developer container 21 and has magnetism. The conveyance blade 23*b* rotates integrally with the shaft part 23*a* and conveys the developer in the developer container 21 the conveyance direction D1 through rotation. The developing chamber 21*b* and the agitating chamber 21*c* configure a developer circulation path. through which the developer agitated and conveyed. The screws 22 and 23 convey the developer in directions opposite to each other, and convey the developer toward the facing screw at a position where the screws 22 and 23 face each other. The toner is rubbed with the carrier through agitation by the screws 22 and 23, and is frictionally charged to negative polarity.

In the present exemplary embodiment, the first conveyance screw 22 has a screw structure in which the conveyance blade 22*b* is spirally provided around the shaft part 22*a*, and a screw diameter is set to 20 mm, a screw pitch is set to 20 mm, and a rotation speed is set to 400 rpm. The second conveyance screw 23 also has a screw structure in which the conveyance blade 23*b* is spirally provided around the shaft part 23*a*. A screw diameter of the second conveyance screw 23 is set to 20 mm. A screw pitch is set to 30 mm on side provided with a replenishing port 28 and is set to 20 mm on side not provided with the replenishing port 28, and thus a conveying property on the side provided with the replenishing port 28 is made larger. A rotation speed is set to 400 rpm.

In the agitating chamber 21*c*, the replenishing port 28 that opens upward is provided at an end on the upstream in the conveyance direction D1 of the developer, and the toner bottle 41 (see FIG. 1) is connected to the replenishing port 28. The toner bottle 41 houses the two-component developer for replenishment (normally, toner/developer for replenishment=100% to 80%) that is a mixture of the toner and the carrier. The toner supplied from the toner bottle 41 is replenished to the agitating chamber 21*c* through the replenishing port 28.

Figure 2:
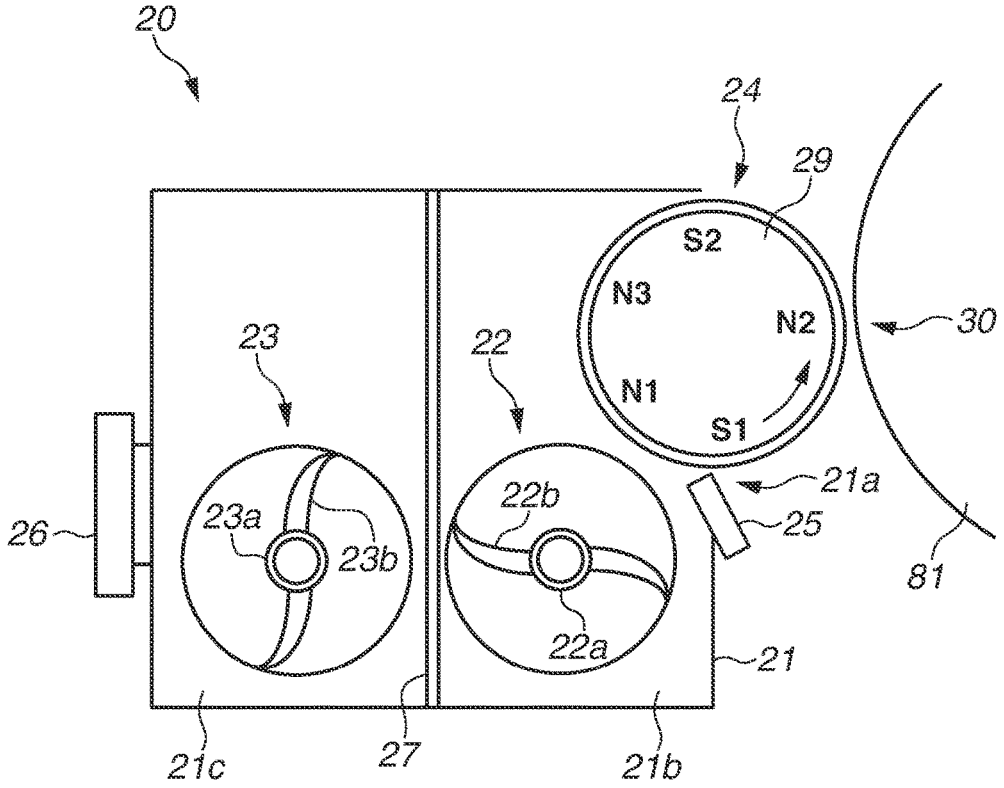
FIG. 2 a cross-sectional view illustrating a schematic configuration of a developing device according to the exemplary embodiment.
Figure 3:
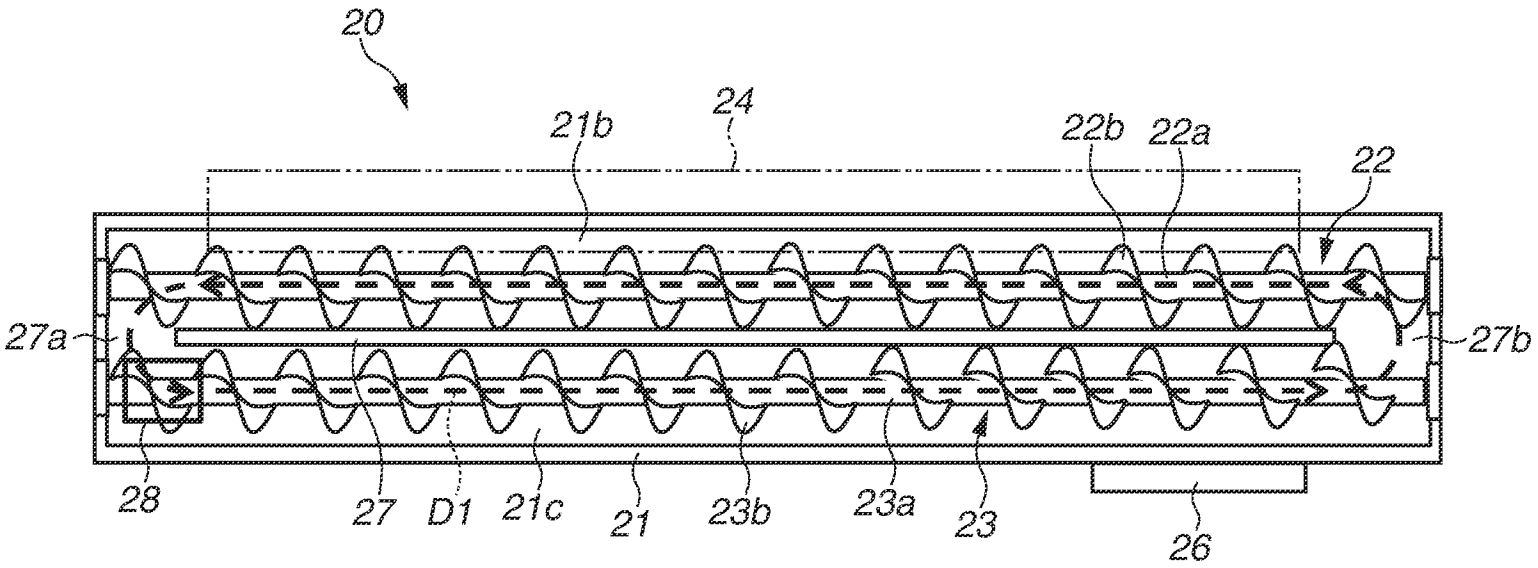
FIG. 3 is a cross-sectional view illustrating the developing device according to the exemplary embodiment in a planar view.

As illustrated in FIG. 2, the developing sleeve carries the developer that contains the nonmagnetic toner and the magnetic carrier, and conveys the developer to a developing region 30 facing the photosensitive drum 81, through rotation. The developing sleeve 24 contains, for example, a nonmagnetic material such as aluminum and nonmagnetic stainless steel. In the present exemplary embodiment, the developing sleeve 24 contains aluminum having the diameter of 20 mm. A roller-shaped magnetic roller 29 is fixed and disposed inside the developing sleeve 24 so as not to rotate relative to the developer container 21. The magnet roller 29 includes a developing magnetic pole N2, and magnetic poles N1, S1, S2, and N3 that convey the developer. The pole N3 and the pole N1 of the same polarity are adjacently disposed inside the developer container 21. The developer peeled off from the surface of the developing sleeve 24 so as to be separated therefrom recovered in the developing chamber 21*b* because repulsive magnetic field is formed between the poles N1 and N3. The developing sleeve 24 includes a plurality of concave parts 31 on the surface, and detail thereof will be described later.

The developer in the developing device 20 is carried on the developing sleeve 24 by the magnet roller 29. Thereafter, the developer on the developing sleeve 24 is regulated in layer thickness by the regulation blade 25, and is conveyed to the developing region 30 that faces the photosensitive drum 81, through rotation of the developing sleeve 24. In the developing region 30, the developer on the developing sleeve 24 is napped to form magnetic brush. The magnetic brush is brought into contact with. the photosensitive drum 81 to supply the toner to the photosensitive drum 81, and the electrostatic latent image of the photosensitive drum 81 is accordingly developed as the toner image.

The regulation blade 25 includes a plate-like nonmagnetic member that contains aluminum, etc., and extends along the axial line of the developing sleeve 24 in the longitudinal direction The regulation blade 25 is disposed on upstream of the developing region 30 in the rotation direction of the developing sleeve 24. Further, both of the toner and the carrier of the developer pass between a front end part of the regulation blade 25 and the developing sleeve 24, thereby being fed to the developing region 30. Adjusting a gap between the regulation blade 25 and the surface of the developing sleeve 24 regulates a nap cut amount of the magnetic brush of the developer carried on the developing sleeve 24, thereby adjusting the developer amount conveyed to the developing region 30.

The inductance sensor 26 is provided on a side wall of the agitating chamber 21*c* and is connected to the control unit 60. The inductance sensor 26 detects toner density of the developer conveyed in the agitating chamber 21*c* and transmits an electric signal to the control unit 60. The control unit 60 uses the inductance sensor 26 to execute automatic toner replenishment (ATR). As a result, the control unit 60 causes the second conveyance screw 23 to agitate and convey the toner supplied from the replenishing port 28 and the developer in the agitating chamber 21*c*, thereby controlling the toner density of the developer to he constant.

Next, the configuration of the surface of the developing sleeve 24 described above will be described in detail with reference to FIG. 4. In FIG. 4, the conveyance direction of the developing sleeve 24 is illustrated as a rotation direction R, upstream side and downstream side thereof are respectively illustrated as UP and DN, and a direction intersecting the rotation direction R is illustrated as a width direction W. Further, a volume average particle diameter (average particle diameter) of carrier C carried on the developing sleeve 24 is regarded as 40 μm.

Figure 4A:
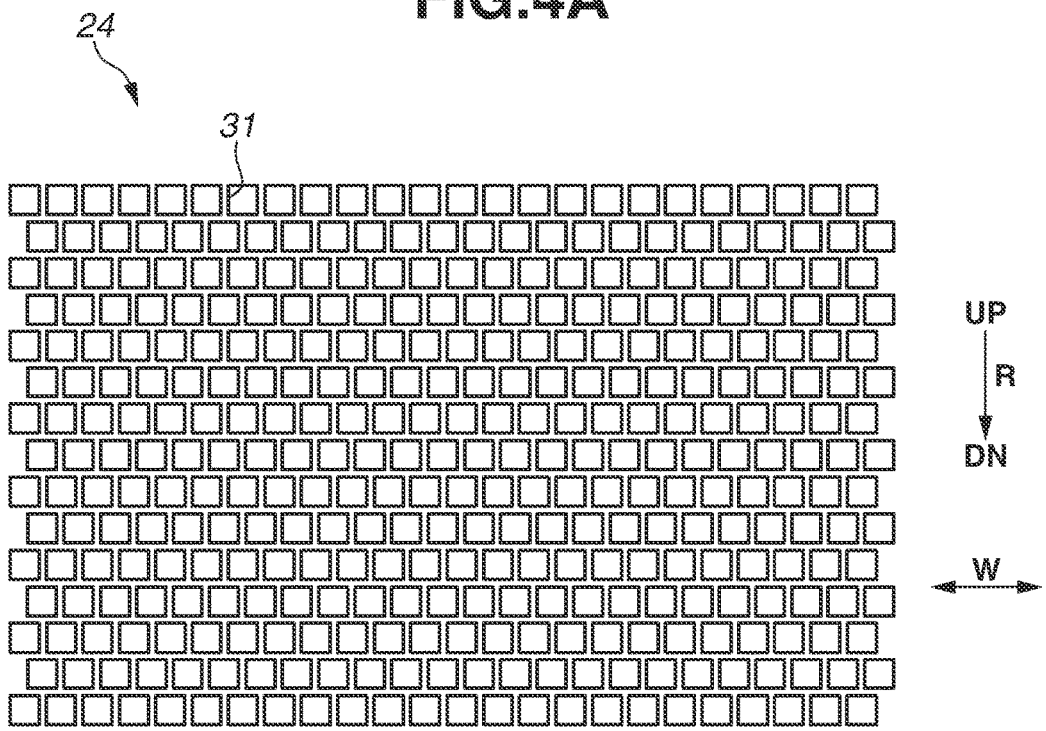
FIGS. 4A and 4B are plan views in a wide range and in an enlarged view, respectively, each illustrating a surface of a developing sleeve of the developing device according to the exemplary embodiment.
Figure 4B:
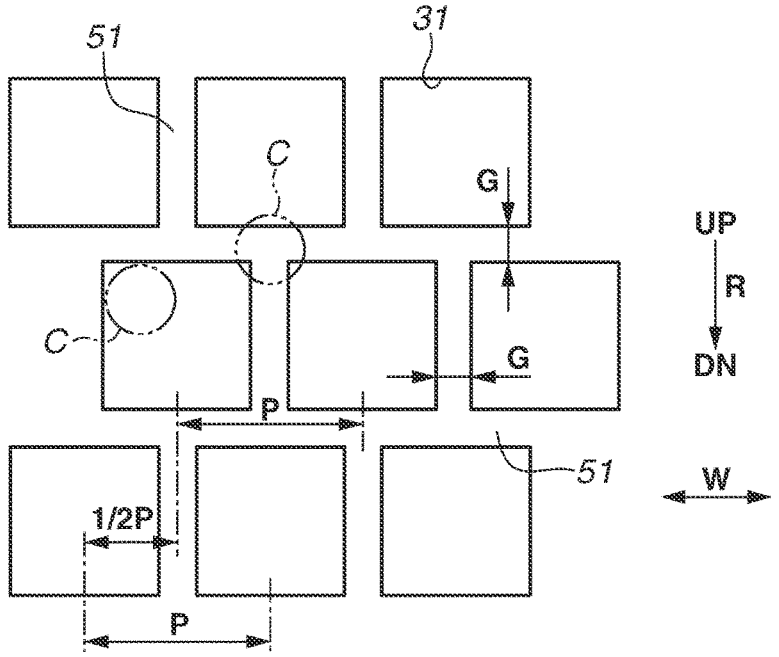

As illustrated in FIG. 4A, the plurality of concave parts 31 are provided on the surface of the developing sleeve 24. The concave parts 31 are disposed periodically in each of the rotation direction R and the width direction W of the developing sleeve 24. The concave parts 31 are disposed with predetermined intervals G in the width direction W. Further, in the rotation direction R, the concave parts 31 are oriented. in a direction inclined to the rotation direction R. The concave parts 31 each have a square shape in which one side extends along the width direction W in a planar view. As illustrated in FIG. 4B, the concave parts 31 are disposed at equal intervals G. The interval G is the shortest distance between the concave parts 31 adjacent to each other. A region other than the concave parts 31 on the surface of the developing sleeve 24, namely, a region among the concave parts 31 serves as a non-concave part 51. In other words, a width of the non-concave part 51 equal to the interval G of the concave parts 31. In the present exemplary embodiment, the interval G of the concave parts 31 is equal to a width between the concave parts 31 in the longitudinal direction of the developing sleeve.

If the interval G between the concave parts 31 adjacent to each. other is large, effect of collecting the magnetic brush in the concave parts 31 is weakened, which increases possibility that the magnetic brush is formed in the non-concave part 51. Therefore, in the present exemplary embodiment, the width of the non-concave part 51, namely, the interval G of the concave parts 31 is made smaller than the volume average particle diameter of the carrier C and is set to approximately 30 μm, for example. With this configuration, a circular surface having a diameter equal to the volume average particle diameter of the carrier C is not included in the non-concave part 51 which are not the concave parts 31, so that it is difficult for the carrier u to exist stably in the non-concave part 51. As a result, the carrier C is less likely to be carried on the non-concave part 51, and the magnetic brush is less likely to be formed in the non-concave part 51, accordingly. Therefore, the magnetic brush is regulated. and formed in the pattern of the concave parts 31, which makes it possible to make uniform the distance between the bristles of the magnetic brush and the length of the magnetic brush formed on the developing sleeve 24.

The concave parts 31 each have a shape that can house the circular shape having the diameter equal to the volume average particle diameter of the carrier C, and are all formed with the same dimension. If the size of each of the concave parts 31 in a planar view can include a projected surface of the carrier C, the carrier C held by the concave parts 31, and the magnetic brush can easily and stably exist at the positions of the concave parts 31. In other words, if each particle of the carrier C is a sphere having a diameter equal to the volume average particle diameter, each of the concave parts 31 includes a circular surface that has the diameter equal to the diameter of the sphere. Further, the magnetic brush typically has a conical shape in which a root is thick and a thickness is gradually reduced toward a tip. Therefore, area of each of the concave parts 31 in a planar view is desirably equal to or larger than the size of four carrier particles in order to more stably hold the magnetic brush. Further, if each of the concave parts 31 has the area equal to or larger than the size of 30 or more carrier particles, the concave part 31 including two the bristles of the magnetic brush appears, and the number of magnetic brush becomes different among the concave parts 31. In this case, the magnetic brush may become non-uniform over the entire developing sleeve 24. Accordingly, each of the concave parts 31 preferably has the area that can house four or more and less than 30 circular shapes each having the diameter equal to the volume average particle diameter of the carrier C. In the present exemplary embodiment, each of the concave parts 31 is formed in a square shape in which one side has a length of 100 μm. The square shape has an area corresponding to a total cross-sectional area of approximately eight carrier C particles having the volume average particle diameter of 40 μm.

The concave parts 31 each desirably have a depth equal to or larger than the volume average particle diameter of the carrier C in order to stably hold the carrier C in the concave parts 31. When the concave parts each have an excessively-large depth, however, the conveyance performance becomes excessively high, and peeling of the developer in a non-magnetic field cannot be sufficiently performed. This may cause a dragging phenomenon in which the developer after the development is conveyed to the developing region again without going through the agitating process. The dragging phenomenon becomes remarkable when the maximum depth of each of the concave parts 31 becomes equal to or larger than four times the volume average particle diameter of the carrier C. Accordingly, the concave parts 31 each preferably have the depth. that is equal to or larger than the volume average particle diameter of the carrier C and smaller than four times the volume average particle diameter of the carrier C. In the present exemplary embodiment, the concave parts 31 each have the maximum depth of 60 μm, and are each formed in a U-shaped concave shape in a cross-sectional view (see FIG. 7B).

For example, the concave parts 31 may be arranged in. a lattice form in which the concave parts 31 are arranged with linearly equal intervals G in each of the width direction W and the rotation direction R. In this case, however, a region where the non-concave part 51 is continuously present is formed over the entire circumference of the developing sleeve 24 in the rotation direction R. In this case, the following possibility is considered. First, when the developer carried on the developing sleeve 24 is conveyed to the region facing the photosensitive drum 81, the developer on the developing sleeve 24 is compressed at a pressure by the photosensitive drum 81. In addition, the circumferential speed of the developing sleeve 24 is typically higher than the circumferential speed of the photosensitive drum 81 for enhancement of developing efficiency of the toner. Accordingly, the speed of the tip of the magnetic brush in contact with the photosensitive drum 81 is reduced in a region where the contact nip starts. At this time, constraint force of the concave parts 31 with respect to the root of the magnetic brush is present, and accordingly, the reduction of the speed is suppressed. The root of the magnetic brush slips on the developing sleeve 24 in the region where the constraint force with respect to the magnetic brush is weak, which reduces the speed of the magnetic brush. As a result, accumulation of the developer in the contact nip easily occurs.

In the case of the configuration in which the non-concave part 51 does not include the circular surface having the diameter equal to the volume average particle diameter of the carrier C as with the present exemplary embodiment, the magnetic brush is less likely to exist in the non-concave part 51. The developer, however, is compressed at the pressure by the photosensitive drum 81 near the region where the developing sleeve 24 and the photosensitive drum 81 come closest to each other in the contact nip. Therefore, the magnetic brush may be present in the non-concave part 51. In this case, in the configuration where the square-shaped concave parts 31 are arranged in a lattice form, the non-concave part 51 is continuously present in the rotation direction R in some part. Consequently, the above-described slip of the magnetic brush may occur, which may cause retention.

In contrast, in the present exemplary embodiment, the concave parts 31 are arranged with linearly equal intervals G in the width direction W, and are arranged with equal intervals G in the rotation direction R such that adjacent columns of the concave parts 31 are shifted by substantially half of a pitch P of the cycle in the width direction W. As a result, another concave part 31 is disposed on an extension of the non-concave part 51, located between the concave parts 31 arranged side by side in the width direction W, in the rotation direction R. Therefore, even if the root of the magnetic brush slips on the non-concave part 51 due to compression by the photosensitive drum 81 in the developing region, the carrier C is constrained by the subsequent other concave part 31, and smoothly passes through the developing region.

The concave parts 31 of the developing sleeve 24 described above may be formed through, for example, electrocasting or etching, or may be formed by mechanically pressing square molds against the surface of the developing sleeve 24 to dent the surface.

As describe above, according to the developing device 20 of the present exemplary embodiment, the concave parts 31 are periodically arranged in each of the rotation direction R and the width direction W of the developing sleeve 24. Further, the concave parts 31 each have the shape that can house tan circular shape having the diameter equal to the volume average particle diameter of the carrier C carried on the developing sleeve 24. Further, the interval G of the concave parts 31 is smaller than the volume average particle diameter of the carrier C. As a result, the carrier C is less likely to be carried between the concave parts 31, and the magnetic brush is less likely to be formed between the concave parts 31. Therefore, the magnetic brush is regulated and formed in the pattern of the concave parts 31. This makes it possible to make uniform the distance between the bristles of the magnetic brush and the length of the magnetic brush formed on the developing sleeve 24, and to make uniform the contact state of the magnetic brush to the photosensitive drum 81 on the downstream of the contact nip in the rotation direction, thereby improving quality of the output image.

Further, according to the developing device 20 of the present exemplary embodiment, the concave parts 31 are arranged with the linearly equal intervals G in the width direction W, and are arranged with the equal intervals G in the rotation direction R such that the adjacent columns of the concave parts 31 are shifted by substantially half of the pitch P of the cycle in the width direction W. As a result, another concave part 31 disposed on the extension of the non-concave part 51, located between the concave parts 31 arranged side by side in the width direction W, in the rotation direction R. Therefore, even if the root of the magnetic brush slips on the non-concave part 51 due to compression by the photosensitive drum 81 in the developing region, the carrier C is constrained by the subsequent other concave part 31, and smoothly passes through the developing region. As a result, the carrier C is less likely to be carried on the non-concave part 51, and the magnetic brush is less likely to be formed in the non-concave part 51. Therefore, the magnetic brush is regulated and formed in the pattern of the concave parts 31, which makes it possible to make uniform the distance between the bristles of the magnetic brush and the length of the magnetic brush formed on the developing sleeve 24.

Figure 5A:
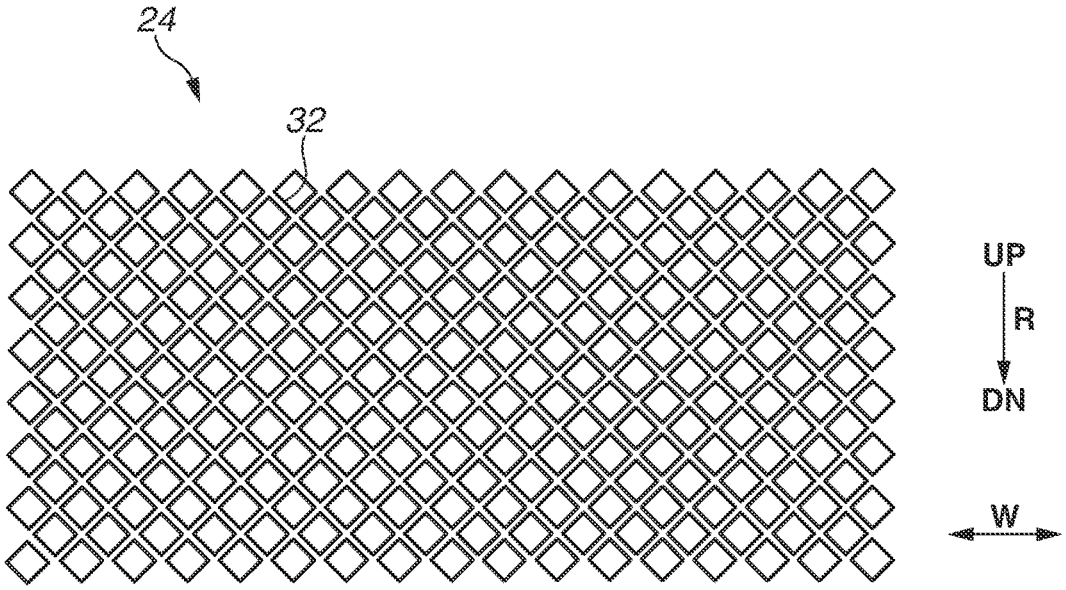
FIGS. 5A and 5B are plan views in a wide range and in an enlarged view, respectively, each illustrating a surface of a developing sleeve of a developing device according to another exemplary embodiment.
Figure 5B:
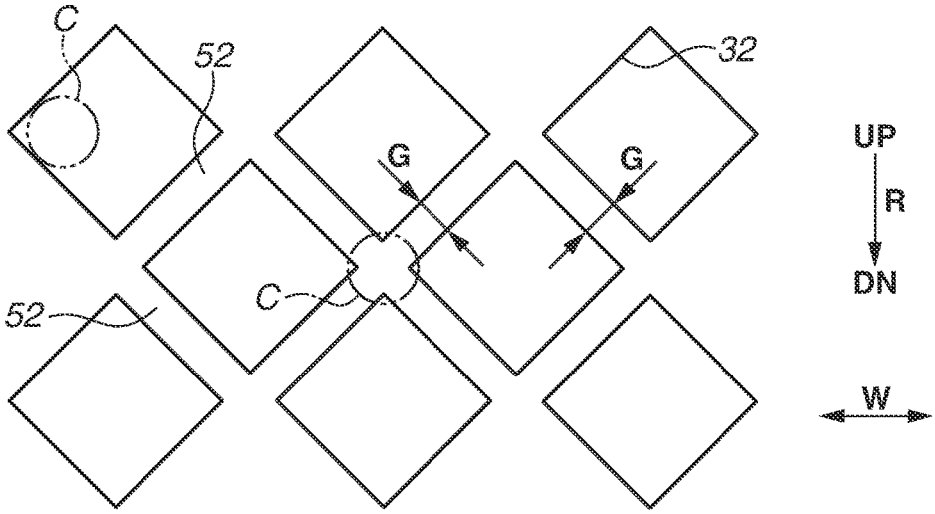

In the above-described developing device 20 of the exemplary embodiment, the case where the concave parts 31 each have the square shape in which the one side extends along the width. direction W has been described; however, the concave parts are not limited thereto. For example, as illustrated in FIG. 5A, concave parts 32 each may have a square shape in which one side is inclined by approximately 45 degrees with respect to the width direction W in a planar view. In this case, as illustrated in FIG. 5B, the concave parts 32 are arranged with linearly equal intervals G in each of two directions that are inclined by about 45 degrees with respect to the width direction W. In this case as well, the carrier C are less likely to be carried between the concave parts 32, and the magnetic brush is less likely to be formed. Therefore, the magnetic brush is regulated and formed in a pattern of the concave parts 32. Further, also in this case, other concave part 32 is disposed on an extension of a non-concave part 52, located between the concave parts 32 arranged side by side in the width direction W, in the rotation direction R. Therefore, even if the root of the magnetic brush slips on the non-concave part 52 due to compression by the photosensitive drum 81 in the developing region, the carrier C is constrained by subsequent other concave part 32, and smoothly passes through the developing region. For these reasons, is possible to make uniform the distance between the bristles of the magnetic brush and the length of the magnetic brush formed on the developing sleeve 24, and to make uniform the contact state of the magnetic brush to the photosensitive drum 81 on the downstream of the contact nip in the rotation direction, thereby improving quality of the output image. In particular, according to the concave parts 32 illustrated in FIG. 5B, since a vertex of the square shape is located on the upstream side UP in the rotation direction R in a planar view, the carrier C tends to be concentrated in the vertex. This makes it possible to concentrate the position of the root of the magnetic brush and to make uniform the distance between the bristles of the magnetic brush and the length of the magnetic brush at a high degree.

Figure 6A:
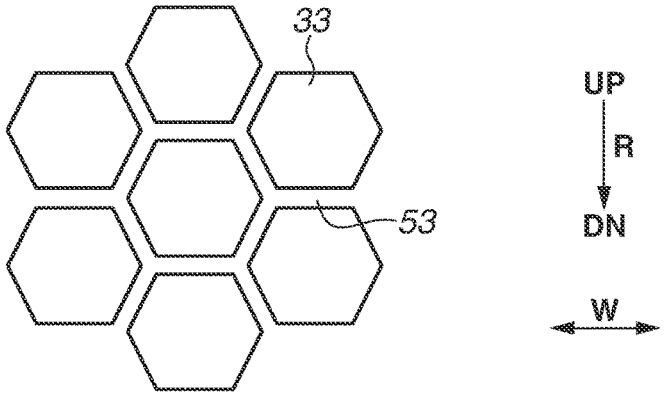
FIGS. 6A, 6B, 6C, and 6D are enlarged views each illustrating a modification of the surface of the developing sleeve of the developing device according to the exemplary embodiment, in a case where a concave part has a regular hexagonal shape, in a case where the concave part has a regular triangle shape, in a case where the concave part has a circular shape, and in a case where the concave part has an elliptical shape, respectively.
Figure 6B:
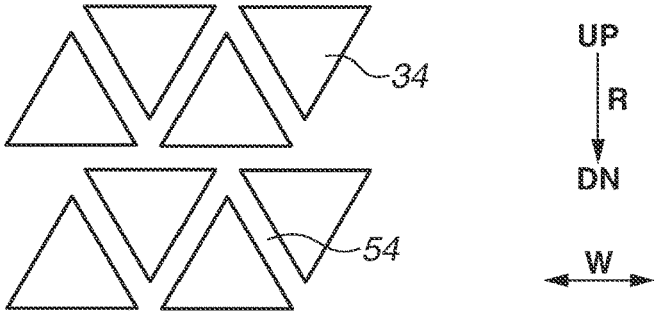

Further, in the developing device 20 of the exemplary embodiment described above, the case where the concave parts 31 and 32 each have the square shape has been described; however, the concave parts 31 and 32 each may have other shapes. For example, as illustrated in FIG. 6A, concave parts 33 each may have a regular hexagonal shape. In this case, the concave parts 33 may be arranged such that one side of each of the concave parts 33 is aligned along the width direction W or the rotation direction R or is appropriately inclined in a planar view. Further, as illustrated in FIG. 6B, concave parts 34 each may have a regular triangle shape. In this case, the concave parts 34 may be arranged such that one side of each of the concave parts 34 is aligned along the width direction W, and a vertex facing the one side alternately faces the upstream side UP and the downstream side DN in the rotation direction R. As described above, the case where the concave parts each have any of the regular triangle shape, the square shape, and the regular hexagonal shape is preferable for making the distance between the bristles of the magnetic brush and the length of the magnetic brush uniform because the concave parts are arranged with minimum equal intervals G.

Figure 6C:
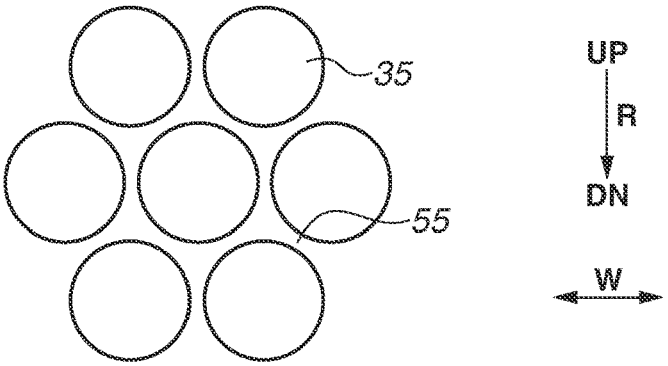
Figure 6D:
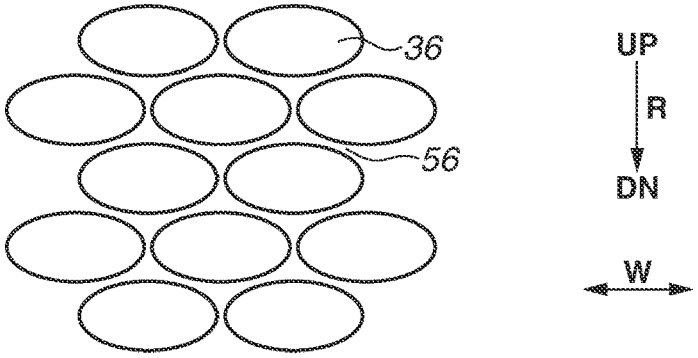

Furthermore, as illustrated in FIG. 6C, concave parts 35 each may have a circular shape. in this case, the concave parts 35 may be arranged such that a center of each of the concave parts 35 is aligned along the width direction W or the rotation direction R, or is appropriately inclined in a planar view, In a case where the concave parts 35 each have a perfect circular shape, the concave parts 35 may be formed through cutting. Further, as illustrated in FIG. 6D, concave parts 36 each may have an elliptical shape. In this case as well, the concave parts 36 may be arranged such that a long axis of each of the concave parts 36 is aligned in the width direction W or the rotation direction R, or is appropriately inclined in a planer view, as with the case of the circular shape.

In particular, when the elliptical shape has a long axis in the width direction W, freedom of movement of the magnetic brush in the rotation direction R is small as compared with the circular shape. In other words, slip of the root of the magnetic brush due to compression by the photosensitive drum 81 in the developing region hardly occurs inside the concave parts 36. This makes it possible to further improve conveyance force of the developing sleeve 24 conveying the magnetic brush.

Also in the case of the above-described concave parts 33, 34, 35, and 36, the interval G between the concave parts is smaller than the volume average particle diameter of the carrier C. Therefore, the carrier C is less likely to be carried between the concave parts and the magnetic brush is less likely to be formed, and the magnetic brush is accordingly regulated and formed in the pattern of the concave parts 33, 34, 35, and 36. This makes it possible to make uniform the distance between the bristles of the magnetic brush and the length of the magnetic brush formed on the developing sleeve 24, and to make uniform the contact state of the magnetic brush to the photosensitive drum 81 on the downstream of the contact nip in the rotation direction, thereby improving quality of the output image.

Figure 7A:
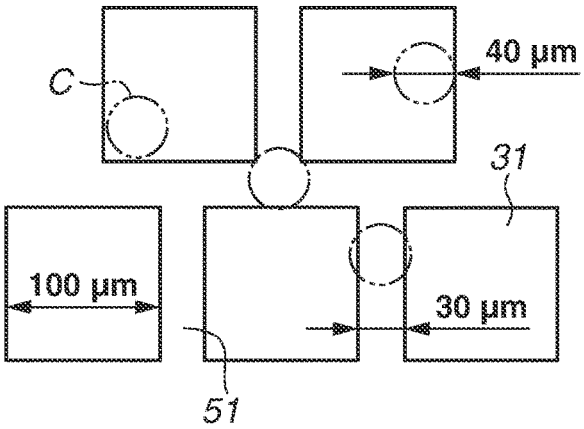
FIG. 7A is an enlarged view illustrating a surface of a developing sleeve of a developing device according to an example.
Figure 7B:
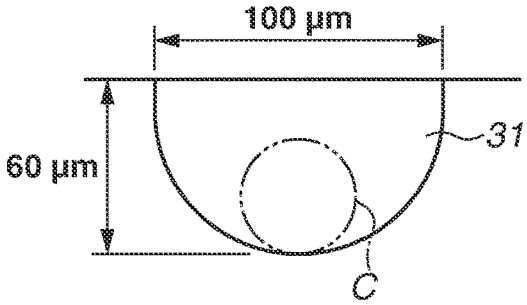
FIG. 7B is a vertical cross-sectional view illustrating a concave part of the developing sleeve of the developing device according to the example.

An image was output by using the developing device 20 of the present exemplary embodiment described above, and roughness was evaluated. One side of each of the square-shaped concave parts 31 was set to 100 μm and an interval between the concave parts 31 was set to 30 μm in a planar view as illustrated in FIG. 7A. Each of the concave parts 31 was formed in a concave shape having a U-shaped bottom shape in cross-section and a maximum depth of 60 μm, as illustrated in FIG. 7B.

An average particle diameter of the volume distribution reference of used magnetic carrier was measured with use of a multi-image analyzer (manufactured by Beckman Coulter, Inc.). As the particle diameter, 50% particle diameter (D50), which is an accumulated value of the volume distribution, was determined. Control and analysis were performed with use of accompanying software (version 10.3.3-202D). Measurement conditions were as follows. SetZero time was set to 10 seconds, a measurement time was set to 10 seconds, the number of measurement times was set to once, a particle refractive index was set to 1.81, a particle shape was set to a non-spherical shape, a measurement upper limit was set to 1208 μm, a measurement lower limit was set to 0.243 μm, and a measurement environment was set to a normal-temperature normal-humidity environment (23° C. and 50% RH). The particle size distribution measurement was performed with use of a laser diffraction/scattering particle size distribution measuring apparatus "Microtrac MT3300EX" (manufactured by Nikkiso Co., Ltd). A sample supplier for identification measurement "one-shot dry-type sample conditioner Turbotrac" (manufactured by Nikkiso Co., Ltd) was attached to perform the measurement. As supplying conditions of Turbotrac, a dust collector was used as a vacuum source, a quantity of air was set to about 33 liters/sec, and pressure was set to 17 kPa. The control was automatically performed on the software. As a result of the measurement, the volume average particle diameter of the carrier C was 40 μm.

The conditions used for output of an image were as follows. A circumferential speed of the photosensitive drum 81 was set to 240 mm/sec, and a circumferential speed of the developing sleeve 24 was set to 432 mm/sec. A charged potential $V_D$ was set to 500 V, an applied direct current voltage $V_{dc}$ was set to 400 V, an alternating current voltage superimposed was a rectangular wave having a peak-to-peak voltage of 1.3 kV with a frequency of 10 kHz. The output images were an entirely solid-black image and an entirely half-tone image in A4 size. The solid-black image used herein indicates an image that has density of approximately 1.4 when the density is measured with use of a reflection spectral densitometer 500 series manufactured by X-Rite Inc., and the half-tone image indicates an image having density of 40% relative to the density of the solid-black image. Results are illustrated in Table 1. As illustrated in Table 1, favorable result and particularly-favorable result were obtained in both. of the solid-black image and the half-tone image.

TABLE 1

| | Roughness Evaluation | |
|---|---|---|
| | Solid--Black Image | Half-Tone Image |
| Example | Particularly Favorable | Favorable |
| Comparative Example 1 | Favorable | Particularly Unfavorable |
| Comparative Example 2 | Favorable | Unfavorable |

A comparative example 1 will be described. The developing sleeve obtained by subjecting the surface to blast processing with use of regular-shaped beads and having a surface roughness Rz of 11 μm was used. Other conditions were similar to those in the example. Results are illustrated in Table 1. As illustrated in Table 1, favorable result was obtained in the solid-black image but particularly-unfavorable result was obtained in the half-tone image.

Figure 7C:
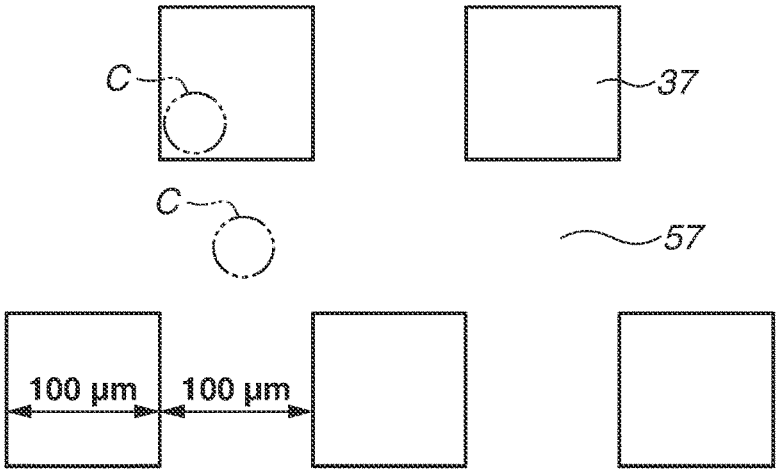
FIG. 7C is an enlarged view illustrating a surface of a developing sleeve of a developing device according to a second comparative example.

A comparative example 2 will be described. The developing sleeve used in the comparative example 2 has square-shaped concave parts 37 periodically arranged similarly to the above-described exemplary embodiment, but an interval between the concave parts 37 adjacent to each other is set to 100 μm as illustrated in FIG. 7C. In other words, a circular surface having a diameter equal to the volume average particle diameter of the carrier C was included in a non-concave part 57. Results are illustrated in Table 1. As illustrated in Table 1, favorable result was obtained in the solid-black image but unfavorable result was obtained. in the half-tone image.

As described above, remarkable difference of roughness appeared in the results of the half-tone image, and roughness became favorable in the case where the developing sleeve 24 of the exemplary example was used as compared with the comparative examples 1 and 2. This is because the magnetic brush is arranged in the pattern of the concave parts 31 provided on the sleeve surface, which makes uniform the state of the magnetic brush. It is inferred that small difference of roughness evaluation in the black-solid image is due to small influence caused by disturbance by non-uniformity of the magnetic brush at the rear end of the contact nip because of a large applied amount of the toner. While the difference of roughness becomes small in the solid-black image, the difference of roughness due to influence of the magnetic brush was observed. As described above, it was confirmed that quality of the output image can be improved by configuring the sleeve surface in such a manner that each of the concave parts 31 has the area larger than the size of one carrier C particle and the non-concave part 51 does not have the area equal to the size of one carrier C particle, and the magnetic brush is arranged in the pattern of the concave parts 31.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-021511, filed Feb. 8, 2017, which is hereby incorporated by reference herein in its entirety.

What is claimed is:

1. A developer bearing member configured to be rotatable and to carry non-magnetic toner and magnetic carrier, the developer bearing member comprising:

a plurality of concave parts provided on a surface of an entire region where developer is carried, in a rotation axis direction of the developer bearing member, wherein each of the plurality of concave parts has a surface size larger than a volume average particle diameter of the carrier, and wherein the plurality of concave parts are arranged to make a shortest distance between each of the plurality of concave parts adjacent to each other smaller than the volume average particle diameter of the carrier.

2. The developer bearing member according to claim 1, wherein the plurality of concave parts are periodically arranged in each of a circumferential direction and the rotation axis direction of the developer bearing member.

3. The developer bearing member according to claim 1, wherein the plurality of concave parts are arranged with predetermined intervals in the rotation axis direction.

4. The developer bearing member according to claim 1, wherein the plurality of concave parts are oriented to an oblique direction relative to a circumferential direction.

5. The developer bearing member according to claim 1, wherein each of the plurality of concave parts has a depth that is equal to or larger than the volume average particle diameter of the carrier and smaller than four times the volume average particle diameter of the carrier.

6. The developer bearing member according to claim 1, wherein each of the plurality of concave parts has surface size that is equal to or larger than four times the volume average particle diameter of the carrier and smaller than 30 times the volume average particle diameter of the carrier.

7. The developer bearing member according to claim 1, wherein each of the plurality of concave parts has a polygonal shape.

8. The developer bearing member according to claim 1, wherein each of the plurality of concave parts has a circular shape.

9. The developer bearing member according to claim 1, wherein each of the plurality of concave parts has an elliptical shape.

10. A developing device, comprising:

a developer bearing member configured to be rotatable and to carry non-magnetic toner and magnetic carrier;

a magnet provided inside the developer bearing member; and a plurality of concave parts provided on surface of an entire region where developer is carried, in a rotation axis direction of the developer bearing member, wherein each of the plurality of concave parts has a surface size larger than. a volume average particle diameter of the carrier, and wherein the plurality of concave parts are arranged to make a shortest distance between each of the plurality of concave parts adjacent to each other smaller than the volume average particle diameter of the carrier.

11. The developing device according to claim 10, wherein the plurality of concave parts are periodically arranged in each of a circumferential direction and the rotation axis direction of the developer hearing member.

12. The developing device according to claim 10, wherein the plurality of concave parts are arranged with predetermined intervals in the rotation axis direction.

13. The developing device according to claim 10, wherein the plurality of concave parts are oriented to an oblique direction relative to a circumferential direction.

14. The developing device according to claim 10, wherein each of the plurality of concave parts has a depth that is equal to or larger than the volume average particle diameter of the carrier and smaller than four times the volume average particle diameter of the carrier.

15. The developing device according to claim 10, wherein each of the plurality of concave parts has a surface size that is equal to or larger than four times the volume average particle diameter of the carrier and smaller than 30 times the volume average particle diameter of the carrier.

16. The developing device according to claim 10, wherein each of the plurality of concave parts has a polygonal shape.

17. The developing device according to claim 10, wherein each of the plurality of concave parts has a circular shape.

18. The developing device according to claim 10, wherein each of the plurality of concave parts has an elliptical shape.

* * * * *